US006026996A

United States Patent [19]

Hayakawa et al.

[11] Patent Number: 6,026,996

[45] Date of Patent: Feb. 22, 2000

[54] BRICK BODY FOR ROTARY NOZZLE AND ROTARY NOZZLE USING SAME

[75] Inventors: Yuji Hayakawa; Masahiro Tsuru; Motoo Amano; Hiroshi Suwabe, all of Kawasaki, Japan

[73] Assignees: NKK Corporation, Tokyo; Nippon Rotary Nozzle Co., Ltd.; Kokan Kikai Kogyo Kabushiki Kaisha, both of Kawasaki; Tokyo Yogyo Kabushiki Kaisha, Tokyo, all of Japan

[21] Appl. No.: 08/930,879

[22] PCT Filed: Feb. 26, 1997

[86] PCT No.: PCT/JP97/00557

§ 371 Date: Sep. 30, 1997

§ 102(e) Date: Sep. 30, 1997

[87] PCT Pub. No.: WO97/31735

PCT Pub. Date: Sep. 4, 1997

[30] Foreign Application Priority Data

Feb. 27, 1996 [JP] Japan ..... 8-039176

[51] Int. Cl.[7] ..... B22D 41/08

[52] U.S. Cl. ..... 222/600; 222/594

[58] Field of Search ..... 266/270, 271; 222/600, 598, 597, 594

[56] References Cited

U.S. PATENT DOCUMENTS 4,618,126 10/1986 Tinnes et al. ..... 266/271
5,709,807 1/1998 Yoshihara ..... 222/600

FOREIGN PATENT DOCUMENTS 61-9965 1/1986 Japan .
615440 1/1994 Japan .

*Primary Examiner*—Scott Kastler
*Attorney, Agent, or Firm*—Ladas & Parry

[57] ABSTRACT

With a rotary nozzle of the type in which a slide plate brick having at least one nozzle bore is rotated so as to adjust the degree of overlapping between the nozzle bore thereof and a nozzle bore of a fixed plate brick to control the rate of pouring of molten steel or the like, the bricks constituting the fixed plate brick and the slide plate brick are formed into the most rational and economical shape for the purpose of seeking a reduction in their cost and also the bricks are used for the purpose of seeking a reduction in the running cost of the rotary nozzle. To achieve these purposes, the shape of the brick 40 is formed into a substantially elliptic shape and nozzle bores 41*a* and 41*b* are provided in the respective eccentric positions.

9 Claims, 8 Drawing Sheets

BRICK BODY FOR ROTARY NOZZLE AND ROTARY NOZZLE USING SAME

TECHNICAL FIELD

The present invention relates to bricks for a rotary nozzle of the type which is attached to the bottom shell of a molten steel vessel constituting a source of molten metal such as a ladle or tundish whereby a slide or slidable plate brick is rotated so as to adjust the degree of opening between nozzle bores in the slide plate brick and a fixed plate brick to control the rate of pouring of molten steel or the like, the invention further relates to a rotary nozzle using such bricks.

BACKGROUND ART

Rotary nozzles have been used widely with ladles for receiving molten steel tapped from a converter to transport the molten steel or pour it into molds, tundishes for receiving the molten steel from a ladle to pour the molten steel into molds, and the like.

For instance, FIG. 10 is a perspective view of a rotary nozzle of the type which has been in wide use and FIG. 11 is a schematic view showing its principal parts in section. In these figures, numeral 4 designates a base member attached to the bottom shell of a ladle 1 or the like, and 5 a support frame pivotably attached to the base member 4 with a hinge and formed with a recess 6 in which fixedly mounted is a fixed plate brick 7 made of a refractory material, having a nozzle bore 8. Note that numeral 2 designates a top nozzle fitted in the bottom shell of the ladle 1 or the like and a nozzle bore 3 of the top nozzle is adapted to be in alignment with the nozzle bore 8 of the fixed plate brick 7. Numeral 12 designates a rotor equipped with a gear 13 on the outer periphery thereof and formed with a recess 14 in which fixedly mounted is a slide plate brick 17 made of a refractory material, having nozzle bores 18, 19, and the rotor 12 being received in a case 28 which is pivotably attached to the base member 4 through a hinge. When the support frame 5 and the case 28 are closed, the slide plate brick 17 is pressed against the fixed plate brake 7 by a large number of springs 29 provided in the case 28. It is to be noted that numerals 24 and 25 designate bottom nozzles respectively having nozzle bores 26 and 27 which are respectively aligned with the nozzle bores 18 and 19 of the slide plate brick 17.

As shown in FIG. 12, the slide plate brick 17 is formed into a planar elliptic shape having flat portions 20*a* and 20*b* formed in parallel at the opposed portions thereof. On the other hand, the recess 14 of the rotor 12 is formed into a shape which is similar to and slightly greater than the slide plate brick 17 and whose sides are formed with locking portions 15 in correspondence to the flat portions 20*a* and 20*b*; and one of the locking portions 15 is formed with a cutout 16. Then, the slide plate brick 17 is received in the recess 14 of the rotor 12 and it is fixedly mounted in the recess 14 by fastening a wedge 22 fitted in the cutout 16 of the rotor 12 with a bolt 23.

The fixed plate brick 7 is also formed into substantially the same shape as the slidable plate brick 17 so that it is received in the recess 6 formed in the support frame 5 and it is fixedly mounted in the recess 6 by fastening screws 9 through locking members 10.

As will be seen from FIG. 10, the rotary nozzle constructed as described above is so designed that after the support frame 5 and the case 28 have been closed, the rotor 12 is rotated by an electric motor 30 through an intermediate gear 31 and the gear 13. Consequently the slide plate brick 17 mounted in the rotor 12 is rotated to optionally adjust the relative position of the nozzle bore 8 of the fixed plate brick 7 to the nozzle bore 18 (or 19) of the slide plate brick 17, and the degree of opening cooperatively defined thereby. It is to be noted that in addition to the previously mentioned elliptic shape, the fixed plate brick 7 and the slide plate 17 may also have a regular octagonal shape as shown in FIG. 13 (Patent Publication No. 4-11298).

While the rotary nozzle of the above-mentioned type is now in wide use because of its various merits over the reciprocating-type slide nozzles, the fixed plate brick and the slide plate brick, forming its principal parts, involve the following problems. That is to say, since the fixed plate brick and the slide plate brick, particularly at the nozzle bores and their surroundings are subject to the danger of producing erosion because of the passage of high temperature molten steel or the like which erosion causes the molten steel or the like to leak, the fixed and slide plate bricks have to be changed for every several charges and thus must be handled as consumable parts. However, as these fixed plate bricks and slide plate bricks are made of expensive refractory material, their cost is high, thus minimizing any possible reduction in cost.

DISCLOSURE OF INVENTION

In view of the foregoing deficiencies, it is an object of the present invention to form fixed plate bricks and slide plate bricks to the most rational and economical shape so as to reduce their surface areas and thereby to attain a reduction in cost.

It is another object of the invention to provide a rotary nozzle capable of attaining a reduced running cost by using such bricks.

To accomplish these objects, a brick for a rotary nozzle according to the present invention has its planar shape designed as a substantially oval shape with its nozzle bores provided in eccentric positions. Thus, it is possible to obtain a maximum effect with a minimum required area. Also, it is possible to minimize the use of expensive refractory material, thus reducing cost, as well as contributing towards improving on the saving of resources, environment and energy.

Further, the brick for a rotary nozzle according to the present invention has an external shape defined by a first circular arc of a radius C+(D/2)+A drawn around the center X of the brick, a second circular arc of a radius E+B drawn around the center Y of each nozzle bore and tangents connecting the first and second circular arcs. Here, designated by C is the distance between the center X of the brick and the center Y of each nozzle bore, by D is the diameter of the nozzle bores in the brick, by E is the radius of the lower end portion of the top nozzle, by A is the safe allowance for the fully-closed nozzle bores of the brick which is 5 mm–1D, for example, and by B is the safe allowance for the fully-open nozzle bores of the brick which is 0–15 mm, for example. As a result, in addition to the previously mentioned effect, there are such effects that the pouring can be effected safely and positively with reduced weight without a danger of leakage of the molten steel or the like.

Further according to the present invention, the above mentioned bricks are used for a slide plate brick and a fixed plate brick in the rotary nozzle in which a slide plate brick having nozzle bores is rotated so as to adjust the degree of overlapping between its nozzle bore a nozzle bore of a fixed plate brick and thereby to control the rate of pouring of molten steel or the like. Thus, there is the effect of pouring molten steel or the like safely and positively without the leakage of molten steel or the like, and moreover reducing the running cost of changing bricks.

BEST MODE FOR CARRYING OUT THE INVENTION

Since a fixed plate brick and a slide plate brick are the same in construction, the slide plate brick will be mainly dealt with in the following discussion and reference to the fixed plate brick will be made as occasion demands. Also, the fixed plate brick and the slide plate brick will be collectively referred to as bricks.

Figure 1:
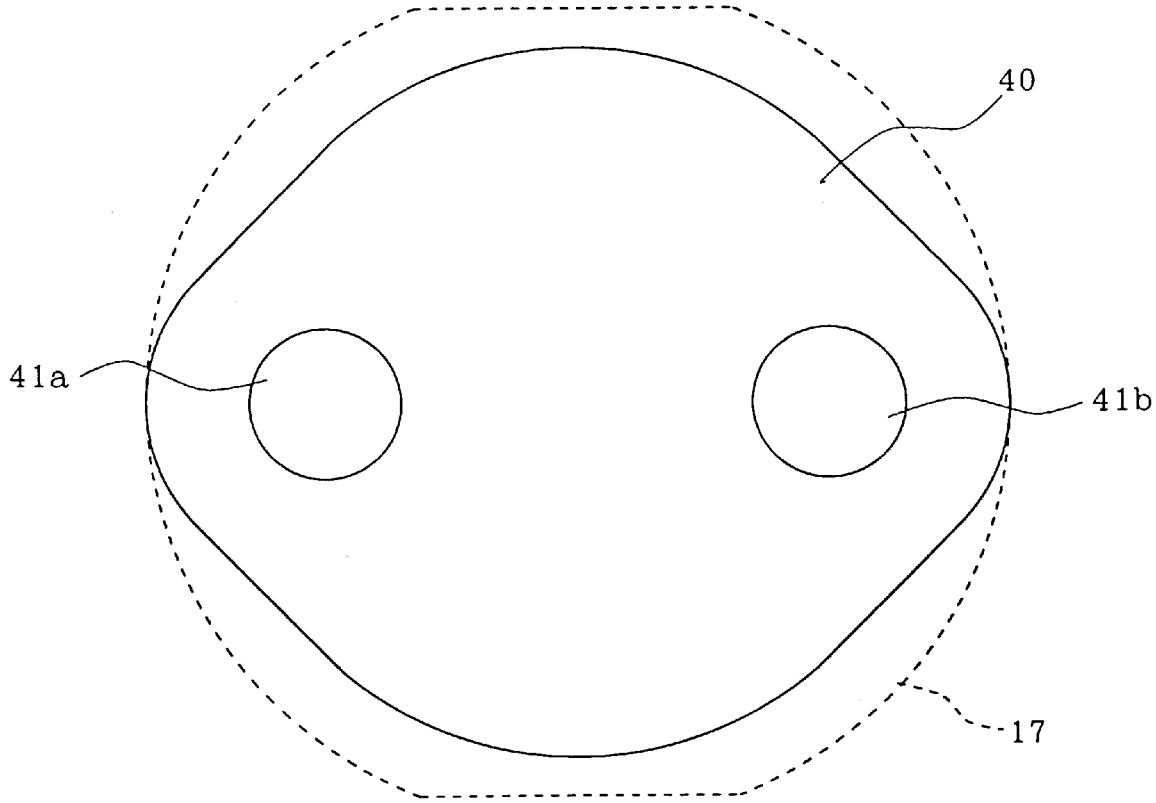
FIG. 1 is a plan view of a slide plate brick of a rotary nozzle according to the present invention.
Figure 2:
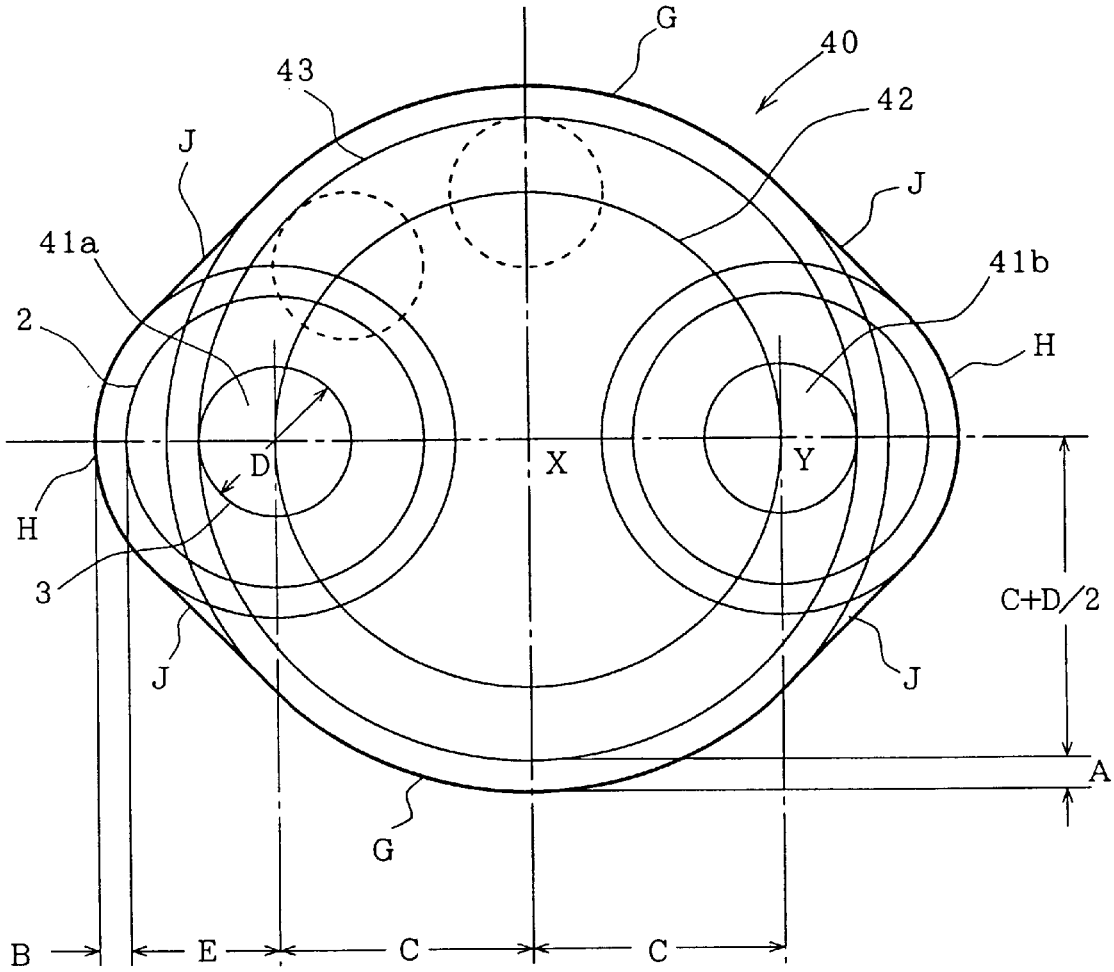
FIG. 2 is a detailed explanatory diagram of FIG. 1.

In FIG. 1, numeral 40 designates a slide plate brick whose planar shape is substantially oval and it is formed with nozzle bores 41*a* and 41*b* in its eccentric positions. Note that shown by a broken line 17 is a conventional elliptical slide plate brick. As shown in FIG. 2, the slide plate brick 40 is formed with nozzle bores 41*a* and 41*b* of a diameter D having centers Y at positions which are each separated from a center X by the distance of a radius C on each side of the center X. Numeral 42 designates the path of rotation of the centers Y of the nozzle bores 41*a* and 41*b*, 43 the circumscribed circle about the nozzle bores 41*a* and numeral 41*b*, drawn with a radius of C+(D/2) around the center X, and 2 is a top nozzle having the center Y, formed with a nozzle bore 3 of a diameter D and having an external shape with a diameter of 2E.

The slide plate brick 40 has a planar shape which is defined by a circular arc G drawn with a radius C+(D/2)+A, namely the radius C+(D/2) of the circumscribed circle 43 about the nozzle bores 41*a* and 41*b* plus a safe allowance A at the fully-closed position of the nozzle bores 41*a* and 41*b*, and around the center X, circular arcs H drawn with a radius E+B, namely the radius E of the top nozzle 2 plus a safe allowance B at the fully-opened position of the nozzle bores 41*a* and 41*b*, and around the centers Y, and tangents J connecting the circular arcs G and H.

Next, the component elements of the above-mentioned slide plate brick 40 will be explained. First, the radius C which determines the positions of the nozzle bores 41*a* and 41*b* is considered. In the case where the radius C is excessively small, if erosion of the nozzle bores 41*a* and 41*b* and their surroundings happens, the nozzle bores 41*a* and 41*b* tend to be connected with each other or the erosion tends to extend over the center X and thus there may be a danger of leakage of molten steel or the like therefrom. As a result, it has been clarified by experiments that the required size is such that the two nozzle bores are accommodated within ¼ of the path of rotation 42 described by the center Y of the nozzle bores 41*a* and 41*b* and therefore it is determined as $2C\pi/4>2D$ and hence $C>4D/\pi$.

Also, the diameter of the nozzle bore 3 of the top nozzle 2, hence the diameter D of the nozzle bores 41*a* and 41*b* is determined depending on such operating conditions as the level of molten steel in a ladle, casting method, casting rate. Further, the outer diameter 2E of the top nozzle 2 is experimentally determined from the diameter D of the nozzle bore 3 in additional consideration of the cracking due to the thermal stress and the erosion of the slide plate brick 40.

Figure 3:
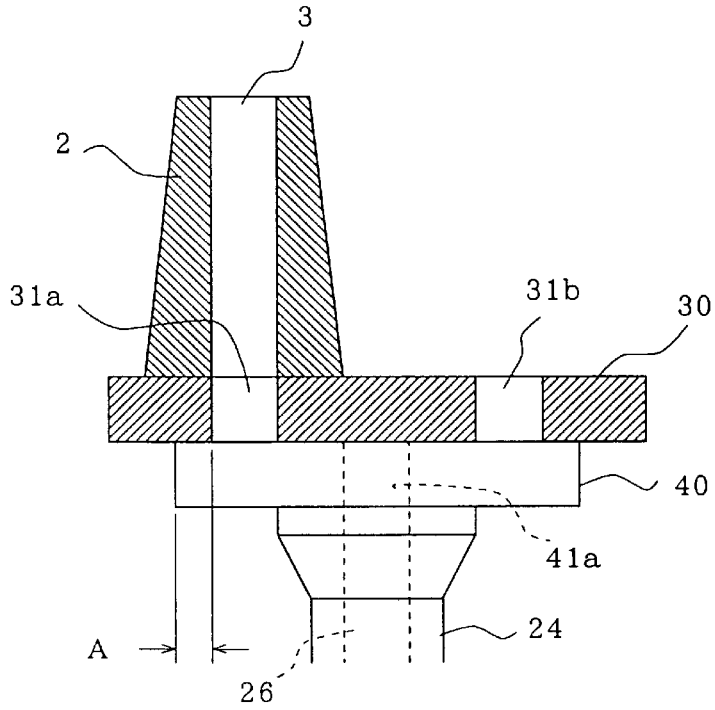
FIG. 3 is an explanatory diagram showing the relation between a top nozzle, a fixed plate brick and a slide plate brick when nozzle bores are fully closed.

Next, the safe allowance A at the fully-closed position of the nozzle bores 41*a* and 41*b* of the slide plate brick 40 as shown in FIG. 3 will be explained. Note that numeral 30 designates a fixed plate brick of the same construction as the slide plate brick 40, and 31*a* and 31*b* are the nozzle bores thereof.

Figure 4:
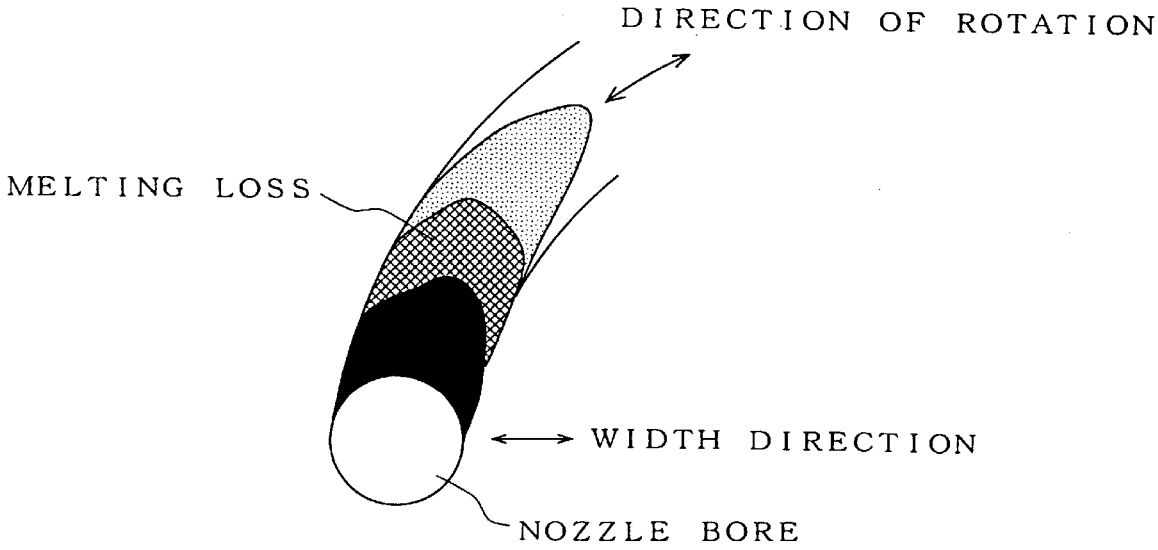
FIG. 4 is an explanatory diagram showing an erosion condition of the slide plate brick.

The erosion conditions of the nozzle bores and their surroundings after the use (at the time of changing) of the slide plate brick in the rotary nozzle are such as shown in FIG. 4. The erosion is caused mainly in the direction of rotation of the nozzle bores and the erosion in the width direction is extremely small, or on the order of ⅕ to ⅙ of the erosion in the direction of rotation. As a result, no large safe allowance is required in the width direction. However, making the safe allowance A extremely small has the danger of causing a leakage of molten steel so that 5 mm and 1 D are selected as the minimum and maximum of A, respectively (here D represents the diameter of the previously mentioned nozzle bores 3, 31*a*, 31*b*, 41*a* and 41*b* of the top nozzle 2, the fixed plate brick 30 and the slide plate brick 40, respectively).

Figure 5:
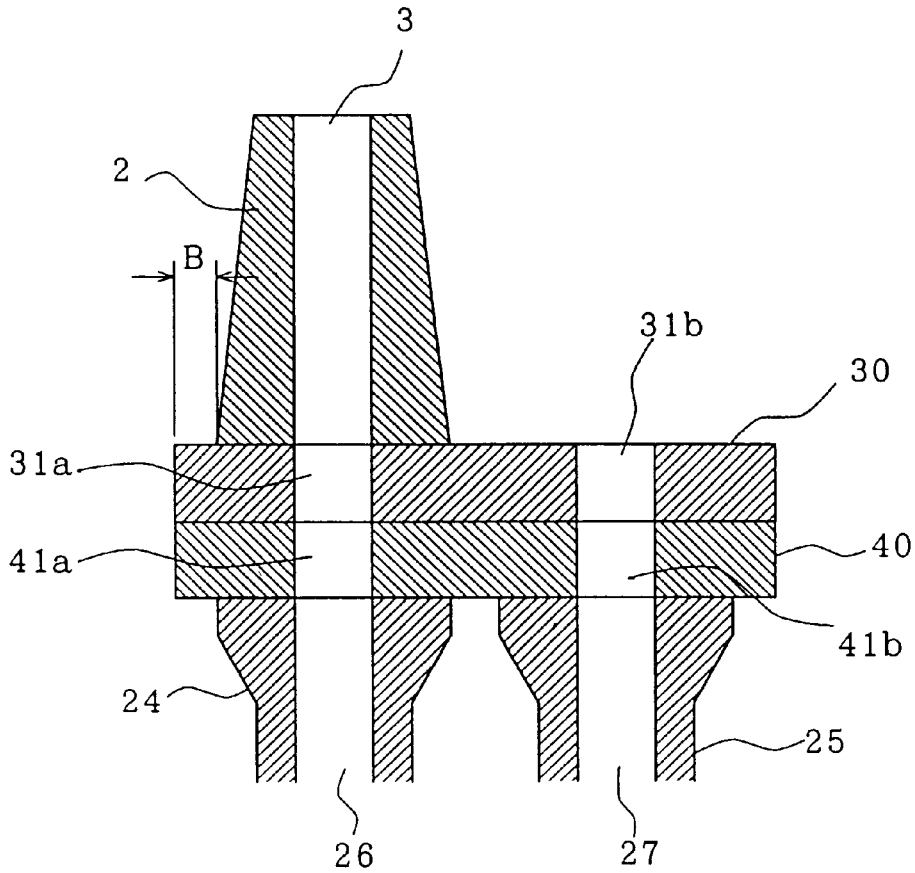
FIG. 5 is an explanatory diagram showing the relation between the top nozzle, the fixed plate brick and the slide plate brick when the nozzle bores are fully opened.
Figure 6:
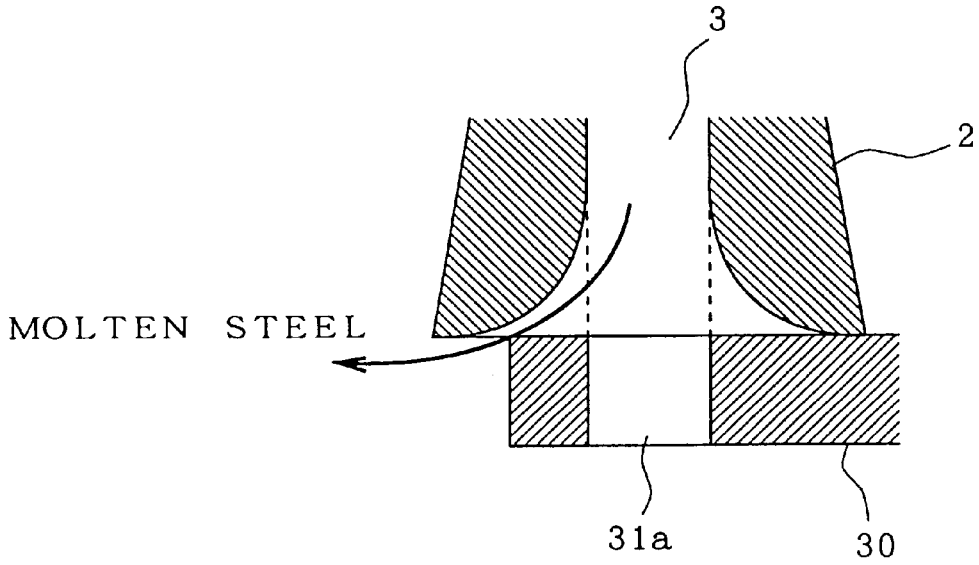
FIG. 6 is an explanatory diagram showing the relation between the top nozzle and the fixed plate brick when the nozzle bores are fully opened.

Also, considering the safe allowance B at the fully-opened position of the nozzle bores 41*a* and 41*b* of the slide plate brick 40 as shown in FIG. 5, if, for example, the periphery of the fixed plate brick is selected to be smaller than the outer diameter of the top nozzle 2 in the event that erosion of the nozzle bore 3 of the top nozzle 2 is caused by molten steel or the like, there is a danger of the molten steel or the like leaking from the joint surface of the top nozzle 2 and the fixed plate brick 30 as shown in FIG. 6. Experimentally, when the nozzle bores 41*a* and 41*b* are fully opened, it is desirable that at least the outer edge of the top nozzle 2 and the outer edge of the fixed plate brick 30 are coincident with each other. As a result, $0 \leqq B \leqq 15$ mm, and preferably $0<B<10$ mm is selected.

Figure 7:
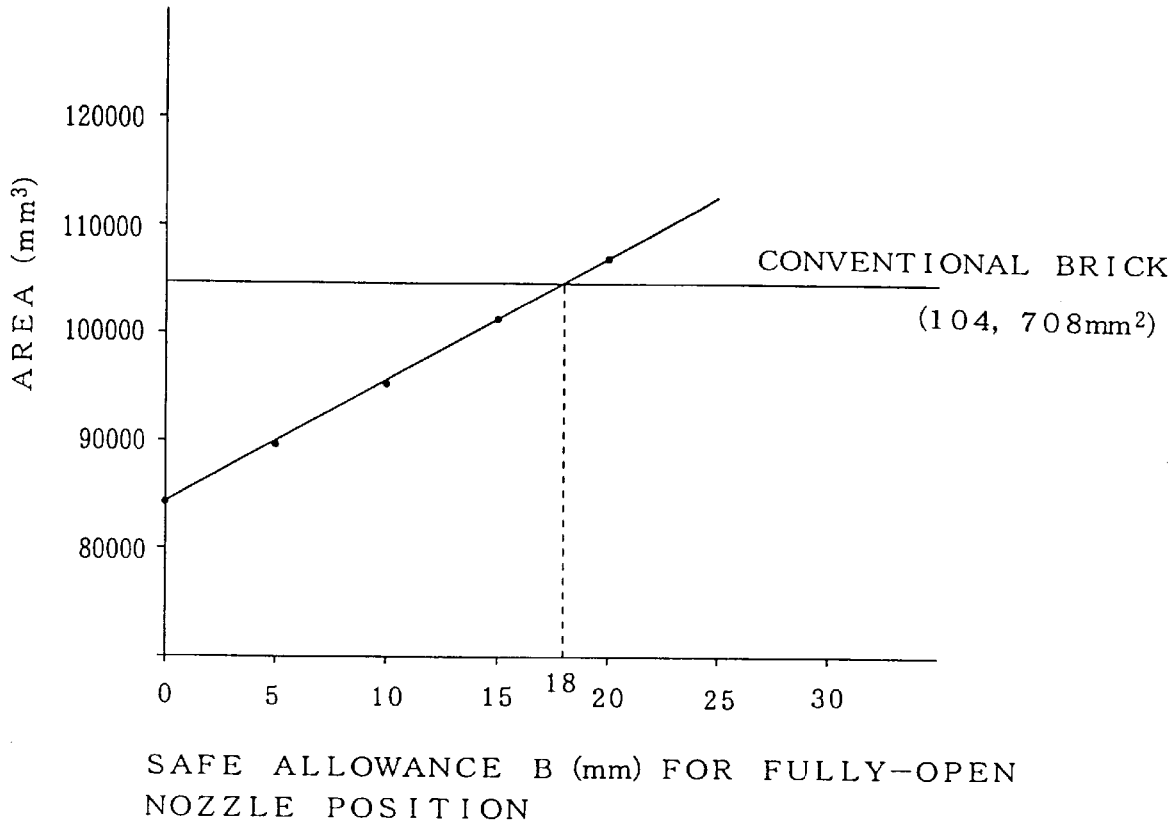
FIG. 7 is a graph showing the relation between magnitude of safe allowance for fully opened nozzle position and surface area of the brick.

The present invention is intended to reduce the surface area of the bricks constituting the fixed plate brick 30 and the slide plate brick 40. Therefore, its effect is decreased if the above mentioned safe allowance B is increased. FIG. 7 is a graph showing the relation between the safe allowance B and the surface area of the bricks in which the surface area becomes equal at the safe allowance of 18 mm to the surface area of the conventional oval brick. As no effect is expected with the safe allowance B greater than 18 mm, 15 mm is selected as the maximum safe allowance B.

Figure 8:
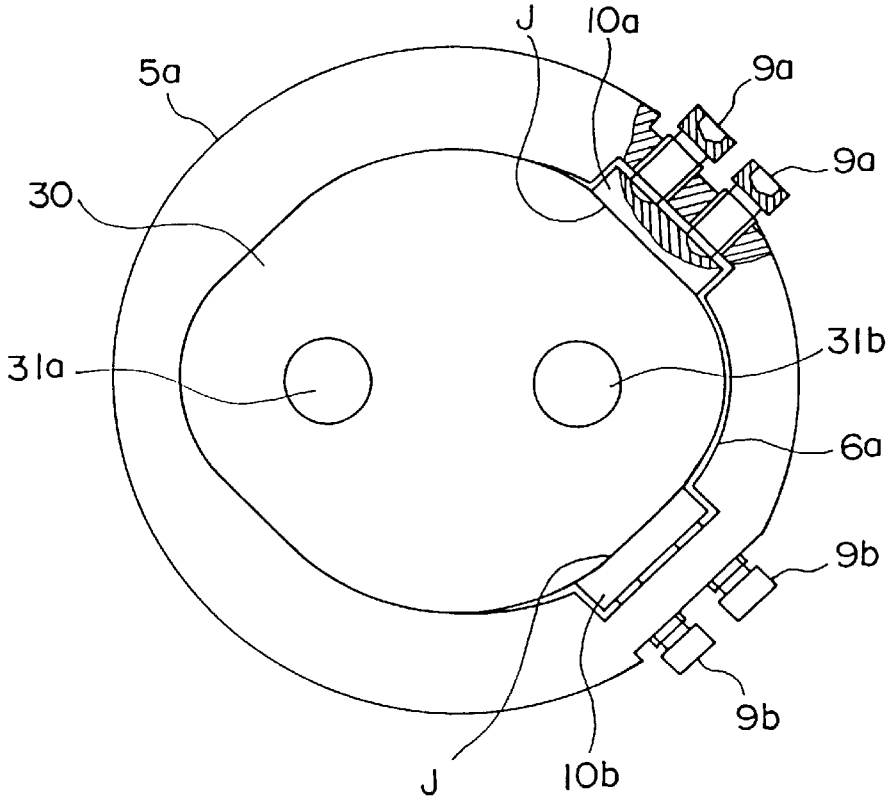
FIG. 8 is a bottom view showing the condition in which the fixed plate brick is mounted in a support frame.

FIG. 8 is a bottom view showing the condition of the fixed plate brick 30 according to the present invention mounted in a support frame 5*a,* in which the support frame 5*a* is formed with a recess 6*a* which is similar in shape to but slightly greater than the fixed plate brick 30 and has a depth slightly smaller than the thickness of the fixed plate brick 30, whereby the fixed plate brick 30 is received in the recess 6*a* and pressed by screws 9*a* and 9*b* through locking members 10*a* and 10*b* at its side wall forming tangents J, J on one side to fix it in place.

Figure 9:
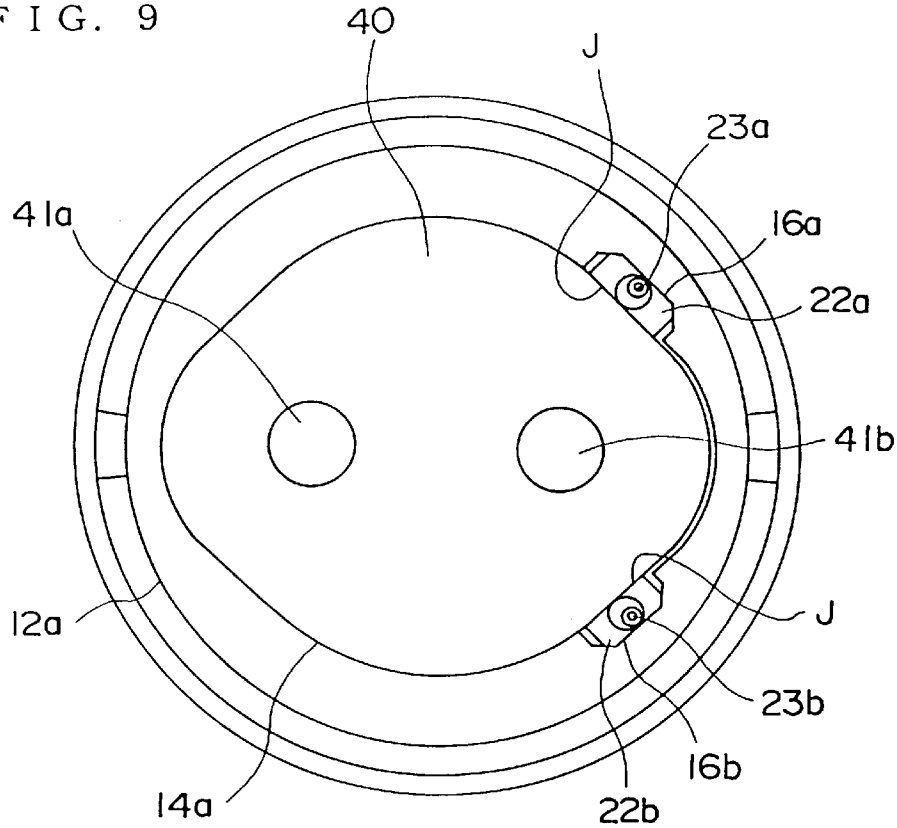
FIG. 9 is a plan view showing the condition in which the slide plate brick is mounted in a rotor.
Figure 10:
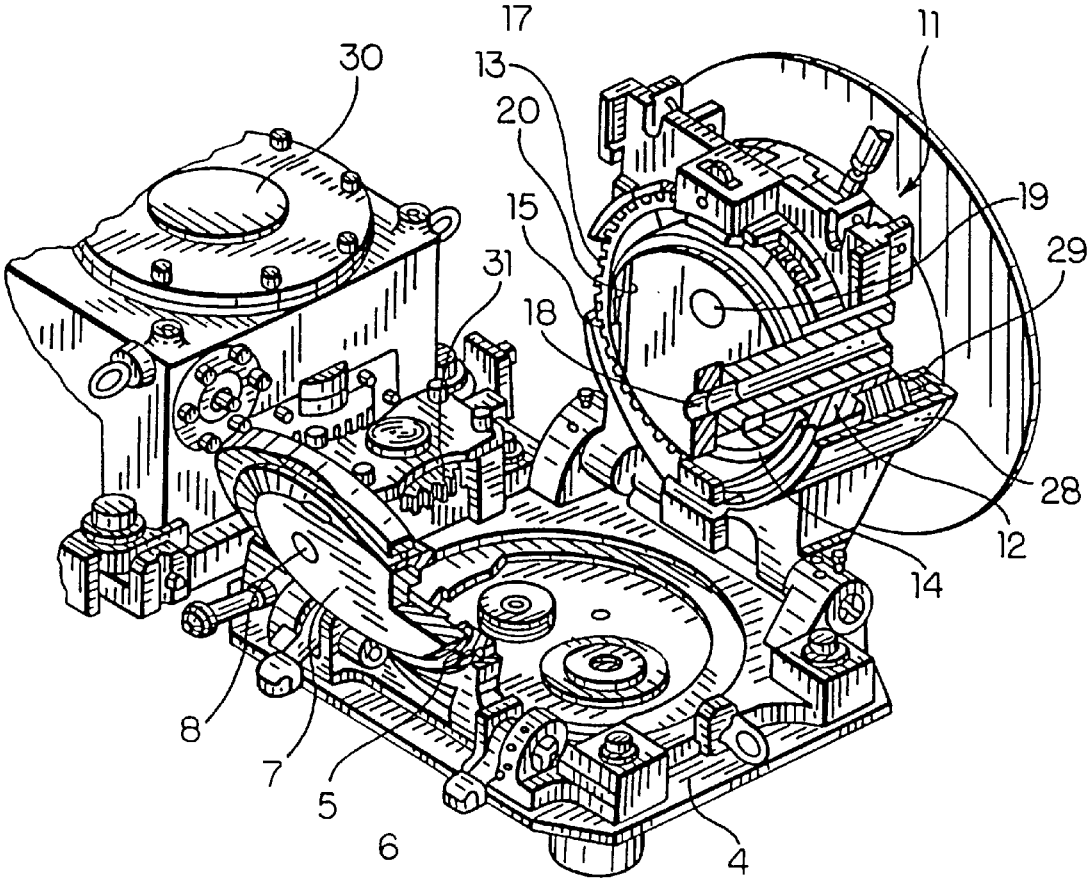
FIG. 10 is a perspective view of an example of a conventional rotary nozzle.
Figure 11:
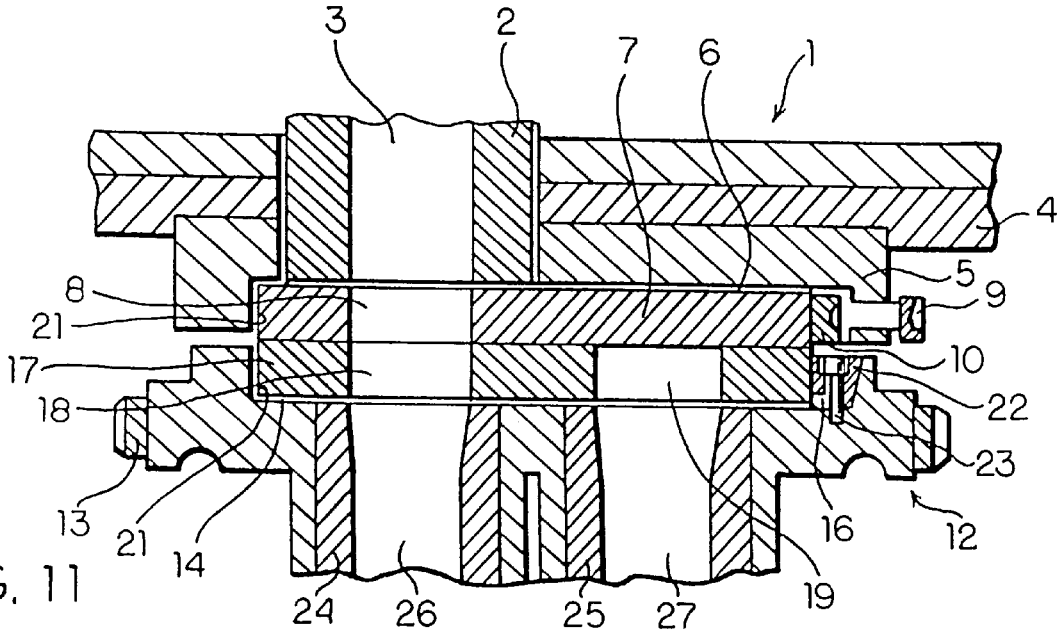
FIG. 11 is a schematic sectional view of FIG. 10.
Figure 12:
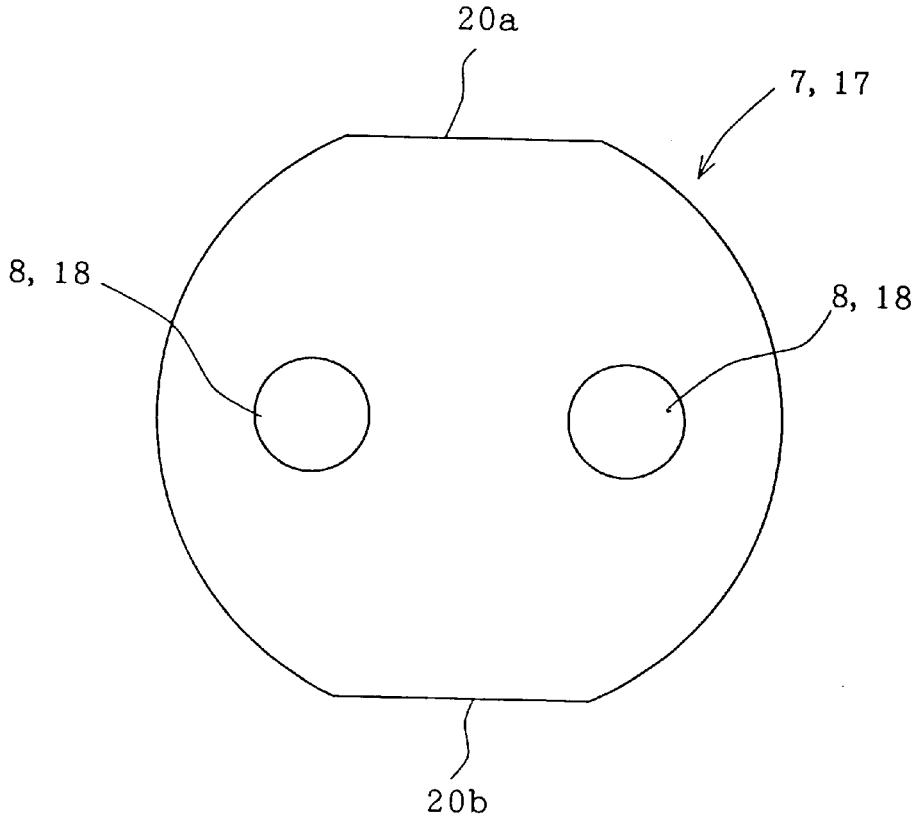
FIG. 12 is a plan view of an example of a conventional brick.
Figure 13:
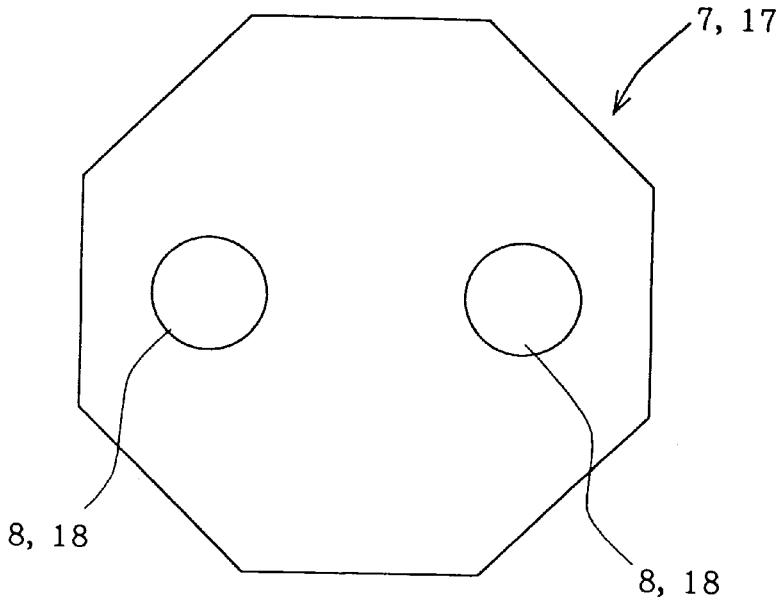
FIG. 13 is a plan view of another example of a conventional brick.

On the other hand, FIG. 9 shows the condition of the slide plate brick 40 mounted in a rotor 12*a,* in which the rotor 12*a* is formed with a recess 14*a* which is similar in shape to but slightly greater than the slide plate brick 40 and has a depth slightly smaller than the thickness of the slide plate brick 40 whereby the slide plate brick 40 is received in the recess 14*a* and pressed by wedge members 22*a* and 22*b* and bolts 23*a* and 23*b* at the side wall forming tangents J, J on one side to fix it in place. It is to be noted that the means for mounting and fixing the fixed plate brick 30 and the slide plate brick 40 to the support frame 5*a* and the rotor 14*a,* respectively, are not limited to those described above and any suitable means can be used.

As described hereinbefore, each of the bricks 30, 40 according to the present invention has its planar shape formed into a substantially oval shape with the safe allowance A formed on the outer periphery of the brick along the outer edges of the nozzle bores at the fully-closed position of the nozzle bores of the brick and selected to be 5 mm–1D, and with the safe allowance B formed on both sides of the nozzle bores along the outer edge of the top nozzle at the fully-opened position of the nozzle bores and selected to be 0–15 mm, thereby the surface area of the bricks is greatly reduced in comparison with the conventional elliptic bricks as seen from FIG. 1. Thus, the raw material used in the bricks is substantially minimized and the cost is reduced.

Also, by using these bricks, it is possible to reduce the size of the resulting rotary nozzle and to reduce its running cost.

While the foregoing description shows the embodiment in which each brick is formed with two nozzle bores, the nozzle bores may number one, three or more.

Further, while the foregoing description is directed to the case in which the bricks are used in a rotary nozzle having a support frame and a rotor which can be opened and closed like a door, the present invention is not limited thereto and the invention can be applied to rotary nozzles employing rotors of various constructions, such as, one in which a fixed plate brick is directly attached to a base member and a slide plate brick is attached to a rotor that can be opened and closed like a door and another in which a slide plate brick is attached to a rotor that can be mounted and demounted vertically.

We claim:

1. In a rotary nozzle having a top nozzle provided with at least one nozzle bore, a fixed plate brick provided with at least one brick bore to be aligned with said nozzle bore and fitted to a source of molten metal, and a slidable plate brick for cooperating with said fixed plate brick to control a pouring of said molten metal, the improvement:

wherein at least one of said bricks is a planar member of oval shape having a major axis and two of said brick bores spaced from each other on said major axis, said oval shape being defined by a pair of first circular arcs of radius C+(D/2)+A on opposite sides of a center X on said major axis, a pair of second circular arcs of radius E+B around centers Y of said brick bores on opposite sides of said center X, and two pairs of tangents connecting said first and second circular arcs;

C is a distance between said center X and each of said centers Y;

D is a diameter of said brick bores;

E is a radius of said top nozzle;

A is a safe allowance between said fixed plate brick and slidable plate brick; and B is a safe allowance between said fixed plate brick and top nozzle.

2. The rotary nozzle according to claim 1, wherein said safe allowance A is in a range between 5 mm. and D, and said safe allowance B is in a range between 0 mm. and 15 mm.

3. The rotary nozzle according to claim 2, wherein C is larger than 4D/π.

4. The rotary nozzle according to claim 1, wherein said at least one of said bricks is both of said bricks.

5. The rotary nozzle according to claim 2, wherein said at least one of said bricks is both of said bricks.

6. The rotary nozzle according to claim 3, wherein said at least one of said bricks is both of said bricks.

7. Bricks for a rotary nozzle comprising:

a fixed plate brick provided with at least one brick bore for alignment with at least one nozzle bore of a rotary nozzle and fitment to a source of molten metal; and a slidable plate brick for cooperating with said fixed plate brick to control a pouring of molten metal through said brick bore, wherein:

at least one of said bricks is a planar member of oval shape having a major axis and two of said brick bores spaced from each other on said major axis, said oval shape being defined by a pair of first circular arcs of radius C+(D/2)+A on opposite sides of a center X on said major axis, a pair of second circular arcs of radius E+B around centers Y of said brick bores on opposite sides of said center X, and two pairs of tangents connecting said first and second circular arcs;

C is a distance between said center X and each of said centers Y;

D is a diameter of said brick bores;

E is a radius of a top nozzle of said rotary nozzle;

A is a safe allowance between said fixed plate brick and slidable plate brick; and B is a safe allowance between said fixed plate brick and top nozzle.

8. The bricks according to claim 7, wherein said safe allowance A is in a range between 5 mm and D, and said safe allowance B is in a range between 0 mm and 15 mm.

9. The bricks according to claim 2, wherein C is larger than 4D/π.

* * * * *